US007473044B2

(12) United States Patent
Collins

(10) Patent No.: US 7,473,044 B2
(45) Date of Patent: Jan. 6, 2009

(54) SOAP HOLDER AND BODY WASHING DEVICE INCLUDING GRIPPING STRAP AND ASSOCIATED METHODS

(75) Inventor: Chadd R. Collins, South Daytona, FL (US)

(73) Assignee: Zionic Management, Inc., Las Vegas, NV (US)

( * ) Notice: Subject to any disclaimer, the term of this patent is extended or adjusted under 35 U.S.C. 154(b) by 204 days.

(21) Appl. No.: 11/267,359

(22) Filed: Nov. 4, 2005

(65) Prior Publication Data

US 2006/0097122 A1 May 11, 2006

Related U.S. Application Data

(60) Provisional application No. 60/625,857, filed on Nov. 8, 2004.

(51) Int. Cl.
*A46B 5/02* (2006.01)
*A47K 7/02* (2006.01)

(52) U.S. Cl. ..... 401/6; 401/201

(58) Field of Classification Search ..... 401/6, 401/7, 8, 196, 201
See application file for complete search history.

(56) References Cited

U.S. PATENT DOCUMENTS

| | | | | |
|---|---|---|---|---|
| 1,861,864 | A * | 6/1932 | Kennedy | 383/75 |
| 3,130,441 | A * | 4/1964 | Hahn | 401/201 |
| 3,674,374 | A * | 7/1972 | Jennings | 401/8 |
| 3,791,746 | A | 2/1974 | Yearka | 401/201 |
| 3,812,849 | A | 5/1974 | Giunta | 128/67 |
| 3,860,349 | A | 1/1975 | Scott | 401/8 |
| 5,031,759 | A | 7/1991 | Ogilvie | 206/77.1 |
| 5,326,610 | A | 7/1994 | Moss | 428/78 |
| 5,486,064 | A | 1/1996 | Schulte | 401/201 |
| 5,545,456 | A | 8/1996 | Suida | 428/76 |
| 5,983,436 | A * | 11/1999 | Mason et al. | 15/222 |
| 6,227,742 | B1 | 5/2001 | Corn et al. | 401/201 |
| 6,398,443 | B1 | 6/2002 | Barela | 401/201 |
| 6,887,007 | B2 | 5/2005 | Sorrell | 401/205 |
| 6,902,338 | B2 * | 6/2005 | Puvvada et al. | 401/201 |
| 2002/0197097 | A1 * | 12/2002 | Rabbani | 401/201 |
| 2003/0208871 | A1 | 11/2003 | Osborne | 15/209.1 |

OTHER PUBLICATIONS

"Hemp Body Scrub Bag", Hemp Basics™, available at www.hempsupply.com/bodycare/7060.asp.

(Continued)

*Primary Examiner*—David J Walczak
(74) *Attorney, Agent, or Firm*—Allen, Dyer, Doppelt, Milbrath & Gilchrist, P.A.

(57) ABSTRACT

A permeable soap holder and body washing device may include a permeable bag for receiving a bar of soap therein and for body contact during washing, and a gripping strap carried by a closed end of the permeable bag to facilitate manipulation of the permeable bag for body contact during washing. The permeable bag may have opposing first and second ends, with the first end being selectively closeable and the second end being closed. The soap holder may further include a drawstring for selectively closing the first end of the permeable bag to permit insertion or removable of a soap bar within the permeable bag. The combination of the drawstring and the gripping strap permits a user to control the soap holder to more readily wash the user's back.

15 Claims, 2 Drawing Sheets

OTHER PUBLICATIONS

"Hemp Soap Bag", available at www.everythingearth.com/hempsoapbag.htm.
"Hemp Soap Bag", available at www.naturallivingstore.com/hempsoapbag.html.
"Hemp Bath Towels and Facecloths", Paivatar Yarns and Designs, available at www.paivatar.com/hemptowels.htm.
"Hemp Soap Bag", available at www.oceantribes.com/catalog/item/892944/465061.htm.

* cited by examiner

SOAP HOLDER AND BODY WASHING DEVICE INCLUDING GRIPPING STRAP AND ASSOCIATED METHODS

RELATED APPLICATION

This application is based upon prior filed provisional application Ser. No. 60/625,857 filed Nov. 8, 2004, the entire subject matter of which is incorporated herein by reference in its entirety.

FIELD OF THE INVENTION

The invention relates to bathroom articles, and, more particularly, to a soap holder and body washing device and associated method.

BACKGROUND OF THE INVENTION

A common bathroom article is a soap holder that a person uses to retain a bar of soap and also wash one's body using the outer surface of the soap holder. For example, U.S. Pat. Nos. 5,031,759; 5,326,610; 5,486,064; and 6,887,007 and published U.S. Patent Application No. 2003/0208871 disclose variations of handheld soap holders for body washing. Such soap holders have also been developed in the form of a glove, such as disclosed in U.S. Pat. No. 6,398,443, for example.

Hemp is an organic material that as a woven fabric has been used in a soap holder because it is slightly abrasive and may be naturally mildew resistant, for example. Its slight abrasiveness makes it desirable for exfoliating the skin while washing. For example, Paivatar Yarns & Design offers a handwoven hemp bag for containing a bar of soap. This product was offered on http://www.paivatar.com/hemptowels.htm. A crocheted hemp soap bag was offered on http://www.oceantribes.com/catalog/item/892944/465061.htm. A similar hemp soap bag was offered by Everything Earth on http://www.everythingearth.com/hempsoapbag.htm. In addition, Hemp Basics of Warren, New Jersey offered a hemp soap bag on its site http://www.hempsupply.com/bodycare/7060.asp.

Unfortunately a typical soap holder and body washing device can only typically be grasped in one hand, and, therefore, is difficult to use to wash certain body areas. In particular, a typical soap holder cannot be readily used to wash one's back.

Attempts have been made to provide back washing devices that incorporate soap holders, however, such devices are typically relatively large and therefore not practical for single hand use. For example, U.S. Pat. Nos. 3,812,849; 3,860,349; 5,545,456; and 6,227,742 each discloses an elongate relatively large device for retaining a bar of soap and being grasped by both of the user's hands for washing the back. U.S. Pat. No. 3,791,746 discloses yet a further more complicated back washer including an arrangement of straps over the shoulder and around the body to facilitate back washing.

SUMMARY OF THE INVENTION

In view of the foregoing background, it is therefore an object of the invention to provide a soap holder and body washing device that can be readily used by one hand of the user to reach accessible areas, but can also be used by both hands of the user to reach less accessible body areas, like the user's back.

This and other objects, features and advantages in accordance with the present invention are provided by a soap holder and body washing device comprising a permeable bag for receiving a bar of soap therein and for body contact during washing, and a gripping strap carried by a closed end of the permeable bag to facilitate manipulation of the permeable bag for body contact during washing. More particularly, the permeable bag may have opposing first and second ends, with the first end being selectively closeable and the second end being closed. The soap holder device may further include a drawstring for selectively closing the first end of the permeable bag to permit insertion or removable of a soap bar within the permeable bag. The combination of the drawstring and the gripping strap permits a user to control the soap holder to more readily wash the user's back, and while still providing a compact device for one handed washing of the user's more accessible body areas.

The gripping strap may comprise an elastic material. For example, the gripping strap may comprise an elastic loop. The permeable bag may comprise a fabric bag. For example, the fabric bag may comprise a hemp fabric bag.

The fabric bag may have a sewn seam closing the second end and closing a side thereof extending between the first and second ends. Accordingly, the gripping strap may be connected to the second end of the fabric bag by the sewn seam. In addition, the first end of the fabric bag may comprise an inwardly folded portion to define a channel to receive the drawstring therein. The drawstring may be in the form of a loop and comprise first and second ends secured to the first side of the fabric bag by the sewn seam.

A method aspect is for making a soap bar holder and body washing device comprising forming a permeable bag for receiving a bar of soap therein and for body contact during washing. The permeable bag may have opposing first and second ends, with the first end being selectively closeable and the second end being closed. The method may also include attaching a drawstring to the first end of the permeable bag for selectively closing the first end of the permeable bag to permit insertion or removable of a soap bar within the permeable bag. The method may additionally include attaching a gripping strap to the second end of the permeable bag to facilitate manipulation of the permeable bag for body contact during washing.

DETAILED DESCRIPTION OF THE PREFERRED EMBODIMENTS

The present invention will now be described more fully hereinafter with reference to the accompanying drawings in which preferred embodiments of the invention are shown. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout.

Figure 1:
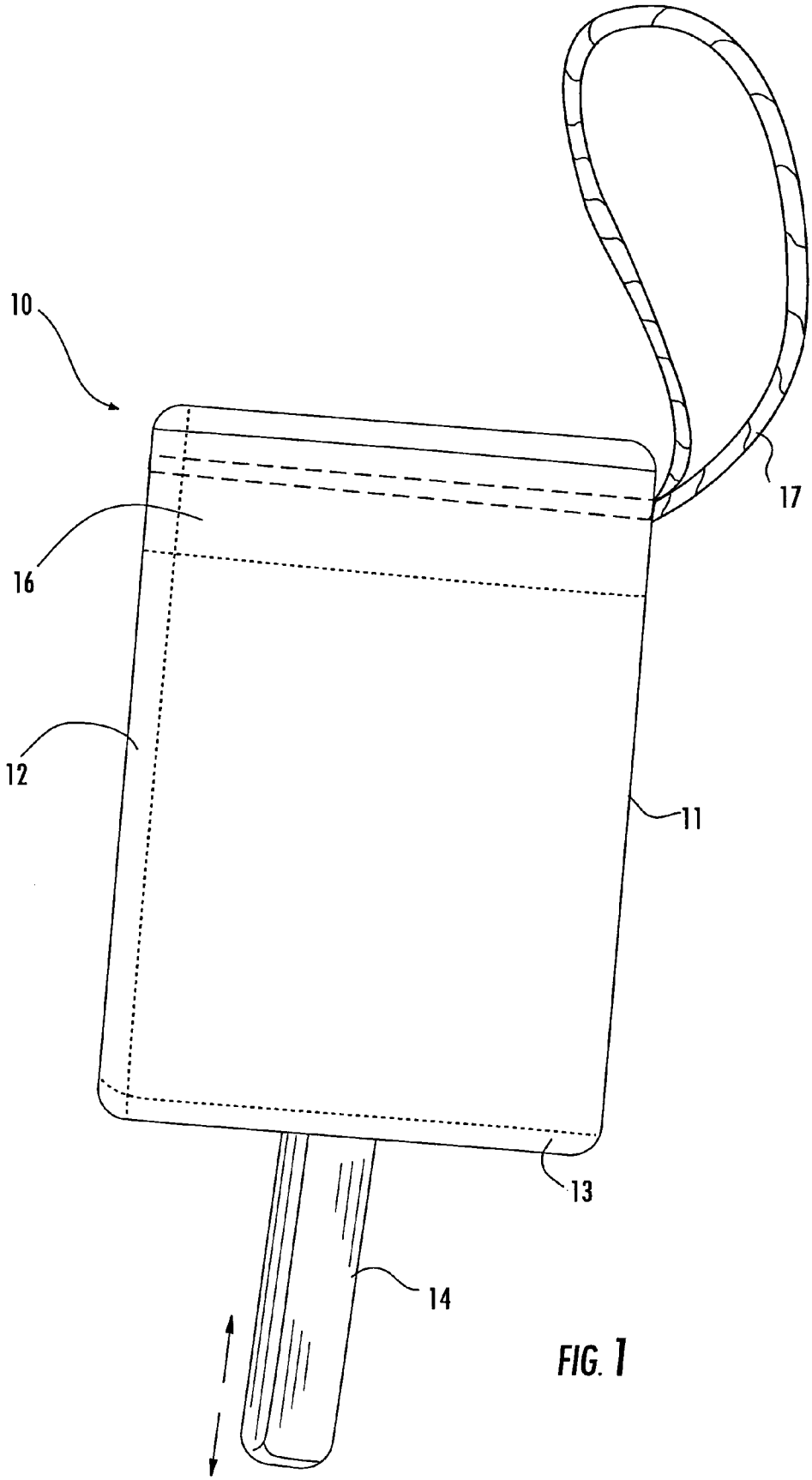
FIG. 1 is a side elevational view of the soap holder and body washing device in accordance with the invention.

The soap holder and body washing device 10 in accordance with the invention is now described with reference to FIGS. 1 and 2. The soap holder device 10 illustratively includes a permeable bag 11 having an open first or upper end and a closed lower or second end. The permeable bag 11 may be a machine or handwoven hemp fabric, for example. The hemp fabric bag may define a tight mesh or a more open mesh, such as would be produced by a crocheted fabric, for example, as will be appreciated by those skilled in the art. Other natural or synthetic materials may also be used as will by appreciated by those skilled in the art.

In the illustrated embodiment, the permeable bag 11 is formed from a single panel of the fabric. The bag 11 is folded along the right hand side of FIG. 1, and is sewn along the left hand side to produce the left hand side sewn seam 12. The bag 11 is also sewn along the lower end and this sewn seam 13 also illustratively attaches the gripping strap 14 to the bag. The left hand side sewn seam 12 and bottom sewn seam 13 so produced are typically inverted so the ends of the fabric panel are on the inside of the bag 11 to thereby improve the appearance, and protect the fabric ends, for example, as will be appreciated by those skilled in the art. In addition, the seams 12, 13 may be formed from multiple fabric folds if greater strength is desired.

The upper end of the bag 11 includes a folded inward portion 16 that defines a channel to receive the ends of the drawstring 17. The ends of the drawstring 17 may be secured at the upper end of the left hand side sewn seam 12 as shown in the illustrated embodiment. Of course, other arrangements for positioning of the drawstring 17 are also contemplated by the present invention.

Figure 2:
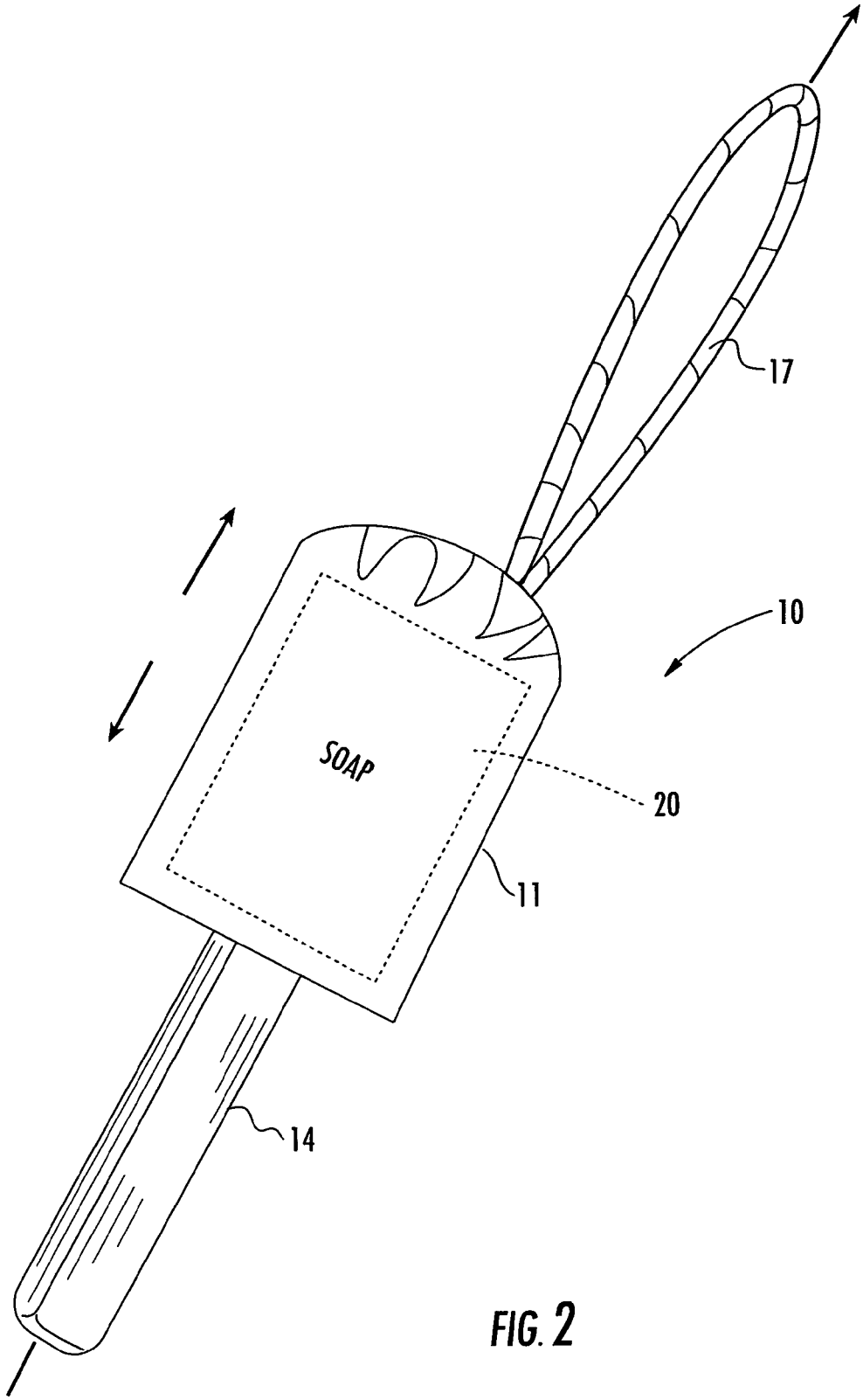
FIG. 2 is an enlarged side elevational view of the soap holder and body washing device as in FIG. 1 with the drawstring and elastic gripping strap in the extended positions as during use.

As shown in FIG. 2, a bar of soap 20 may be positioned and retained within the permeable bag 11 of the soap holder 10. Hemp has the noted advantages of slight abrasiveness and it may be naturally resistant to mildew, for example, as explained above. Moreover, the soap holder and body washing device 10 includes the gripping strap 14 at its lower end that, in combination with the drawstring 17, permits a user to grasp each with an opposite hand so that the soap holder can be used to wash a difficult to access body area, such as the user's back.

The gripping strap 14 may be elastic, such as in the form of an elastic loop. The drawstring 17 is also in the form of a loop, but can be a non-elastic cord. Of course, in other embodiments the drawstring 17 could also be elastic.

The elastic gripping strap 14 may be particularly advantageous as it permits tension to be applied to more readily control positioning of the soap bag and body washing device 10 in use, as will be appreciated by those skilled in the art. In addition, the elastic gripping strap 14 will return to a shortened position (FIG. 1) so as not to interfere with normal one-handed washing.

The permeable bag 11 may have a width in a range of about two to five inches, and a length of about four to seven inches. The gripping strap 14, in the unextended or relaxed position, may have a width in a range of about one quarter inch to one and one-half inch, and a length in a range of about one to four inches. The drawstring 17 may have a length in a range of about four to six inches in the drawn tight position. The drawstring 17 may retain the upper end of the permeable bag 11 in the closed position through friction, or may be tied, or a separate cinching device may be used (not shown) as will be appreciated by those skilled in the art.

Method aspects relate to making the soap holder and body washing device 10 as described herein. In other embodiments, materials other than hemp may be used in the fabric bag 11, and in other embodiments, the gripping strap 14 may not require elastic properties. The gripping strap could also be in the form of a drawstring on the opposite end of the bag. Accordingly, many modifications and other embodiments of the invention will come to the mind of one skilled in the art having the benefit of the teachings presented in the foregoing descriptions and the associated drawings. Accordingly, it is understood that the invention is not to be limited to the embodiments disclosed, and that other modifications and embodiments are intended to be included within the scope of the appended claims.

That which is claimed is:

1. A soap bar holder and body washing device comprising:

a permeable bag for receiving a bar of soap therein and for body contact during washing;

said permeable bag having opposing first and second ends, the first end being selectively closeable and the second end being closed;

a drawstring for selectively closing the first end of said permeable bag to permit insertion or removable of a soap bar within said permeable bag;

said drawstring forming a closed loop to define a handle; and an elastic loop gripping strap carried by the second end of said permeable bag to facilitate manipulation of said permeable bag for body contact during washing.

2. The soap bar holder and body washing device according to claim 1 wherein said permeable bag comprises a fabric bag.

3. The soap bar holder and body washing device according to claim 2 wherein said fabric bag comprises a hemp fabric bag.

4. The soap bar holder and body washing device according to claim 2 wherein said fabric bag has a sewn seam closing the second end and closing a side thereof extending between the first and second ends.

5. The soap bar holder and body washing device according to claim 4 wherein said gripping strap is connected to the second end of said fabric bag by the sewn seam.

6. The soap bar holder and body washing device according to claim 4 wherein the first end of said fabric bag comprises an inwardly folded portion to define a channel to receive said drawstring therein.

7. The soap bar holder and body washing device according to claim 6 wherein said drawstring comprises first and second ends secured to the first side of said fabric bag by the sewn seam.

8. A soap bar holder and body washing device comprising:

a hemp bag for receiving a bar of soap therein and for body contact during washing;

said hemp bag having opposing first and second ends, the first end being selectively closeable and the second end being closed;

a drawstring for selectively closing the first end of said hemp bag to permit insertion or removable of a soap bar within said hemp bag;

said drawstring forming a closed loop to define a handle; and an elastic loop gripping strap carried by the second end of said hemp bag to facilitate manipulation of said hemp bag for body contact during washing.

9. The soap bar holder and body washing device according to claim 8 wherein said hemp bag has a sewn seam closing the second end and closing a side thereof extending between the first and second ends; and wherein said elastic gripping strap is connected to the second end of said fabric bag by the sewn seam.

10. The soap bar holder and body washing device according to claim 9 wherein the first end of said hemp bag comprises an inwardly folded portion to define a channel to receive said drawstring therein; and wherein said drawstring comprises first and second ends secured to the first side of said bag by the sewn seam.

11. A method for making a soap bar holder and body washing device comprising:

forming a permeable bag for receiving a bar of soap therein and for body contact during washing, the permeable bag having opposing first and second ends, the first end being selectively closeable and the second end being closed;

attaching a drawstring to the first end of the permeable bag for selectively closing the first end of the permeable bag to permit insertion or removable of a soap bar within the permeable bag;

the drawstring forming a closed loop to define a handle; and attaching an elastic loop gripping strap to the second end of the permeable bag to facilitate manipulation of the permeable bag for body contact during washing.

12. The method according to claim 11 wherein the permeable bag comprises a fabric bag.

13. The method according to claim 12 wherein the fabric bag comprises a hemp fabric bag.

14. The method according to claim 12 wherein the fabric bag has a sewn seam closing the second end and closing a side thereof extending between the first and second ends; and wherein the gripping strap is connected to the second end of the fabric bag by the sewn seam.

15. The method according to claim 12 wherein the first end of the fabric bag comprises an inwardly folded portion to define a channel to receive the drawstring therein; and wherein the drawstring comprises first and second ends secured to the first side of the fabric bag by the sewn seam.

* * * * *